United States Patent [19]

Lemke et al.

[11] Patent Number: 4,526,968

[45] Date of Patent: Jul. 2, 1985

[54] QUATERNARY AMINEHYDROXYPROPANE SULFOBETAINES

[75] Inventors: Kenneth W. Lemke, Englishtown; Maynard W. McNeil, Washington, both of N.J.

[73] Assignee: M&T Chemicals Inc., Woodbridge, N.J.

[21] Appl. No.: 399,101

[22] Filed: Jul. 16, 1982

Related U.S. Application Data

[62] Division of Ser. No. 295,349, Aug. 24, 1981, Pat. No. 4,430,171.

[51] Int. Cl.[3] ..... C07D 213/02; C07D 215/10; C07D 217/00; C25D 3/18

[52] U.S. Cl. ..... 546/139; 204/48; 204/49; 204/44.5; 544/237; 544/335; 546/102; 546/172; 546/339; 548/143; 548/262

[58] Field of Search ..... 546/139, 172, 339

[56] References Cited

U.S. PATENT DOCUMENTS

| | | | |
|---|---|---|---|
| 2,903,464 | 9/1959 | Werner | 546/139 |
| 3,107,249 | 10/1963 | Cavallito et al. | 546/139 |
| 3,280,130 | 10/1966 | Gundel | 546/139 |
| 3,930,832 | 1/1976 | Serban | 546/139 |
| 4,062,849 | 12/1977 | Foulletier et al. | 546/139 |

*Primary Examiner*—Glennon H. Hollrah
*Assistant Examiner*—James H. Turnipseed
*Attorney, Agent, or Firm*—S. A. Marcus; S. H. Parker; J. Matalon

[57] ABSTRACT

A aqueous electroplating bath for nickel, cobalt, nickel-cobalt, nickel-iron, cobalt-iron or nickel-cobalt-iron is described which contains, as a brightening agent, a quaternary amine sulfobetaine of the formula

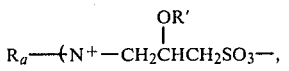

wherein ( N+ is a heterocyclic tertiary amine group,
R is a halogen or lower alkyl group,
R′ is a hydrogen, lower alkyl or R″C(O)— group
R″ is a lower alkyl group and
a is 0–5.

These brighteners may be prepared by the reaction of a heterocyclic tertiary amine with an alkali metal halohydrin sulfonate.

4 Claims, No Drawings

QUATERNARY AMINEHYDROXYPROPANE SULFOBETAINES

This is a divisional of application Ser. No. 295,349, filed Aug. 24, 1981 now U.S. Pat. No. 4,430,171.

BACKGROUND OF THE INVENTION

1. Field of the Invention

This invention relates generally to the electrodeposiston of nickel, cobalt, nickel-cobalt, nickel-iron, cobalt-iron or nickel-cobalt-iron. More particularly, it relates to certain N-(sulfopropyl) quaternary ammonium inner salt additives for aqueous electroplating baths that produce bright and level electrodeposits of these metals and alloys.

2. Description of the Prior Art

A recurring problem in the electrodeposition of nickel, cobalt or the above alloys thereof from an aqueous plating bath is the deposition of a metal film having a surface that is dull or discolored in low current density areas. This defect often can be minimized by the addition to the bath of any of a wide variety of water soluble brightening additives, which are described extensively in *Modern Electroplating,* Third Edition, F. Lowenheim, Ed., pages 287–341, the contents of which are hereby incorporated by reference. Among these brighteners are numerous aminoaliphatic derivatives of oxygenated sulfur-containing acids, examples of which are disclosed in U.S. Pat. Nos. 3,331,868; 3,376,308 and 3,592,943.

Because of the hydrolytic instability in an acid medium of such brighteners in which the aliphatic portion of the molecule is bonded to an oxy or thio atom, these additives exhibit a rapid decline in effectiveness. Brighteners in which both a tertiary amine nitrogen atom and a hexavalent sulfur atom of an oxygenated sulfur-containing acid are directly bonded to an otherwise unsubstituted aliphatic group have, therefore, been favored. A typical brightener of this type is the N-(3-sulfopropyl) quaternary ammonium inner salt, 1-pyridinium-propane-3-sulfobetaine, which is disclosed in U.S. Pat. No. 2,876,177. This compound has been found to be particularly effective when used in combination with ethylene oxide adducts of acetylenic alcohols, as disclosed in U.S. Pat. No. 3,862,019. A major disadvantage of this sulfobetaine plating bath additive is the fact that it is synthesized from the condensation product of pyridine and propane sultone. The latter compound, which is not commercially available and difficult to make, also is considered to be a carcinogen by the Environmental Protection Agency. Although 1-pyridinium-propane-3-sulfobetaine is a very effective nickel brightener, its practical utility is severly limited by the cost of its synthesis and the necessity of removing all unreacted propane sultone.

SUMMARY OF THE INVENTION

This invention thus provides an aqueous electroplating bath for producing bright and uniform electrodeposits of nickel, iron, cobalt, nickel-cobalt, nickel-iron, cobalt-iron or nickel-cobalt-iron. More specifically it provides a plating bath containing a sulfobetaine brightening additive which has a long effective life in an acid medium, which easily can be made from non-carcinogenic starting materials and which does not require purification before addition to the bath.

Broadly, this invention comprises a plating bath for the electrodeposition of metal, which bath comprises an aqueous solution of at least one metal salt selected from salts of nickel and cobalt and a sulfobetaine brightening agent of the formula

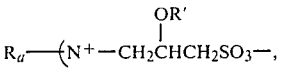

$$R_a—(N^+—CH_2\overset{\overset{OR'}{|}}{C}HCH_2SO_3—,$$

wherein (N+ is a heterocyclic tertiary amine group,

R is a halogen or lower alkyl group,

R′ is a hydrogen, lower alkyl or R″C(O)— group

R″ is a lower alkyl group and a is 0–5.

A further aspect of this invention is a process for the production of quaternary amine-hydroxypropanesulfobetaines of the above formula comprising reacting a heterocyclic tertiary amine with an alkali metal halohydrin sulfonate. The alkali metal halohydrin sulfonate may be produced from an alkali metal bisulfate and an epihalohydrin.

DETAILED DESCRIPTION OF THE INVENTION

The sulfobetaine components of the plating baths of this invention have been found to be effective brighteners and to be fully compatible with the generally used components of otherwise conventional aqueous baths for the electrodeposition of nickel, cobalt, nickel-cobalt, nickel-iron, cobalt-iron or nickel-cobalt-iron. They also have been found to exhibit unexpectedly long effective lives in an acid medium, in spite of the presence of an oxy group that is directly bonded to the aliphatic portion of the brightener molecule.

As discussed more fully below, the quaternary ammonium group in the generic formula set forth above, is derived from any heterocyclic tertiary amine; i.e., any tertiary amine in which a nitrogen atom is a ring member. When R is present in the above generic formula (i.e., when a is one or more), it may be a halogen group, such as methyl, isopropyl or heptyl. R′ may be a hydrogen or R″C(O)— group, where R″ is a lower alkyl group such as methyl, isobutyl or hexyl.

Exemplary of the heterocyclic tertiary amines from which the $R_a$— (N+ group in the generic formula may be derived are:

| | |
|---|---|
| pyridine | naphthyridine |
| chloropyridine | phthalazine |
| dibromopyridine | phenazine |
| lutidine | pyrindine |
| pyrizine | isopyrrole |
| triazine | isothiazole |
| tetrazine | oxazole |
| oxazine | furazan |
| quinoline | pyridizine |
| isoquinoline | isotriazole |
| cinnoline | indolenine |
| benzoxazine | benzofurazan |
| acridine | pyrimidine |

Tertiary amines containing a single nitrogen atom in an aromatic ring are preferred and unsubstituted tertiary aromatic amines, such as pyridine, quinoline or isoquinoline, are especially preferred.

The hydroxy-sulfobetaine brighteners of this invention may be prepared following the method of Tsunoo, Berichte 68, 1334 (1935). However, it has been found that improved yields are obtained, and lower amounts of heterocyclic tertiary amine consumed, when the sulfobetaine is prepared by refluxing an aqueous solution of the heterocyclic tertiary amine and an alkali metal halohydrin sulfonate to yield the sulfobetaine and byproduct alkali metal halide. The alkali metal halohydrin sulfonate is readily obtained by the reaction of sodium or potassium hydrogen sulfite with an epihalohydrin, as described in Tsunoo, such as epichlorhydrin or epibromohydrin. For completeness of reaction, it generally is desirable to employ up to about a 10% excess of the amine. The reaction does not require the use of flammable organic solvents and can be conducted over a wide temperature range. Conveniently, the reaction is conducted at the reflux temperature of the aqueous mixture.

EXAMPLE 1

A flask equipped with a reflux condenser is charged with 59 grams of sodium 3-chloro, 2-hydroxypropane sulfonate, 35 grams of pyridine and 150 grams of water. After refluxing for 8 hours, 1 gram of calcium carbonate is added and 60 milliliters of condensate is removed. The remaining reaction product is cooled and diluted to 250 milliliters with water. The yield of 1-pyridinium-2-hydroxypropane-3-sulfobetaine, as measured by UV absorbance, is 90% based on sodium 3-chloro, 2-hydroxypropane sulfonate.

EXAMPLE 2

The above experiment is repeated, except that the reaction product is evaporated to dryness on a rotary evaporator. The resulting solids are treated with 200 milliliters of concentrated hydrochloric acid and insoluble sodium chloride removed by filtration. The filtrate is evaporated to dryness and treated with methanol to precipitate pure product. After washing with acetone until the washings give a negative test with silver nitrate, the product is dried to give 57 grams of a white solid which contains 44.16% carbon, 4.92% hydrogen, 6.61% nitrogen and 0% chlorine. This corresponds closely to the theoretical value for 1-pyridinium-2-hydroxypropane-3-sulfobetaine of 44.2% carbon, 5.1% hydrogen and 6.5% nitrogen. The high purity of this material is evident from its measured melting point of 246°–47° C., as compared to a 242° C. melting point reported by Tsunoo, supra.

EXAMPLE 3

A flask equipped to the reflex condenser is charged with 59 grams of sodium 3-chloro, 2-hydroxypropane sulfonate, 35 milliliters of quinoline and 50 milliliters of water. After refluxing for 65 hours, unreacted quinoline is removed azeotropically by the use of a Dean-Stark trap. The reaction mixture is then cooled, resulting in the precipitation of a white solid. After recrystallizing from water, 30 grams of this solid is obtained which darkened but did not melt at 300° C. The elemental analysis is correct for 1-quinolinium-2-hydroxypropane-3-sulfobetaine.

While the quaternary ammonium-hydroxy propane-sulfobetaines of this invention also can be synthesized by the method of Tsunoo, supra, the method shown in Examples 1 through 3 is superior in a number of important respects. For example, it does not require the use of a large excess of amine, as the byproduct halide is in the form of alkali metal halide, rather than amine hydrohalide. In addition, any small quantity of unreacted amine, which sometimes may be present in a reaction product, and the alkali metal halide byproduct are not harmful for the intended use and the entire reaction product therefore may be employed in a plating bath. Any such unreacted amine and alkali metal halide can, of course, easily be removed by known techniques. For example the sulfobetaine product can be purified by azeotropically removing the unreacted amine and precipitating the byproduct alkali metal halide from a concentrated hydrochloric acid solution.

The sulfobetaines of this invention which contain an ester group can, by standard esterification procedures, be prepared by reacting the quaternary amine hydroxypropanepropane-sulfobetaine with an organic acid or acid anhydride. It generally is preferred to employ for this purpose a lower alkanoic acid or anhydride, such as acetic anhydride, propanoic acid or butanoic acid.

The following Example 4 illustrates the preparation of one such ester containing sulfobetaine.

EXAMPLE 4

A flask equipped with a reflux condenser is charged with 10 grams of 1-pyridinium-2-hydroxypropane-3-sulfobetaine and 50 milliliters of acetic anhydride. After refluxing for 18 hours, the reaction mixture is cooled and filtered and 10 grams of the white solid product having a melting point of 292° C. is recovered. Elemental analysis shows that it is 1-pyridimium-2-acetoxypropane-3-sulfobetaine.

The following Examples 5 through 9 illustrate the improvements obtained by incorporating the quaternary amine sulfobetaines of this invention to otherwise conventional nickel plating baths. In each example, a cleaned steel panel is plated in a 1,000 milliliter Hull cell for 10 minutes at 2 amperes cell current using air agitation and the plating bath composition shown in Table I below.

It is to be understood that these bath compositions incorporate a number of widely utilized bath additives in accordance with usual commercial practice. However, these additives are optional and the novel brighteners of this invention may be utilized as the sole additive.

TABLE I

| | Composition of Baths | | | | |
|---|---|---|---|---|---|
| | Ex. 5 | Ex. 6 | Ex. 7 | Ex. 8 | Ex. 9 |
| $NiSO_4.6H_2O$ (g/l) | 300 | 300 | 300 | 300 | 300 |
| $NiCl_2.6H_2O$ (g/l) | 60 | 60 | 60 | 60 | 60 |
| $H_3BO_3$ (g/l) | 45 | 45 | 45 | 45 | 45 |
| pH | 4.0 | 4.0 | 4.0 | 4.0 | 4.0 |
| Temp. °C. | 60 | 60 | 60 | 60 | 60 |
| sodium o-sulfobenzimide (g/l) | 2.7 | 2.7 | 2.7 | 2.7 | 2.7 |
| propargyl alcohol (g/l) | 0.005 | — | 0.005 | — | 0.005 |
| monoethoxylated propargyl alcohol (g/l) | 0.01 | — | 0.01 | — | 0.01 |
| 2-butyne-1,4-diol (g/l) | 0.02 | — | 0.02 | — | 0.02 |
| diethoxylated butyne diol (g/l) | — | 0.05 | — | 0.05 | — |
| 1-quinolinium-2-hydroxypropane-3-sulfobetaine (g/l) | — | — | 0.06 | 0.06 | — |
| 1-pyridinium-2-acetoxypropane-3-sulfobetaine (g/l) | — | — | — | — | 0.06 |

The results of visual examination of panels of Examples 5 through 9 are shown in Table II.

TABLE II

| Example | Condition of Test Panels Observation |
|---|---|
| 5 | Fair to good brightness and leveling in high and medium current density areas. Hazy in low current density areas. |
| 6 | Poor to fair brightness and leveling in high and medium current density areas. Hazy in low current density areas. |
| 7 | Good brightness and leveling in all areas |
| 8 | Good brightness and leveling in all areas |
| 9 | Good brightness and leveling in all areas |

EXAMPLE 10

Example 6 is repeated except that a sufficient quantity of the reaction product of Example 1 is added to the bath to provide 0.06 grams per liter of bath of 1-pyridinium-2-hydroxypropane-3-sulfobetaine. The resulting panel, when compared with that of Example 6, shows an increase in brightness and leveling and a reduction in haze.

Generally, the concentration of nickel salts utilized in electroplating baths will fall with the following ranges:

| | Range | Preferred |
|---|---|---|
| $NiSO_4.6H_2O$ | 150–400 g/l | 300 g/l |
| $NiCl_2.6H_2$ | 40–135 g/l | 60 g/l |
| Total $Ni^{+2}$ | 45–120 g/l | 80 g/l |
| $H_3BO_3$ | 30–55 g/l | 45 g/l |

Thus, a typical bath incorporating the materials of this invention would have the following composition.

$NiSO_4 \cdot 6H_2O$: 300 g/l
$NiCl_2 \cdot 6H_2O$: 60 g/l
$H_3BO_3$: 45 g/l
pH: 4.0
Temperature: 60° C.
Sodium o-sulfobenzimide: 2.7 g/l
Sodium allyl sulfonate: 1.6 g/l
Propargyl Alcohol: 0.0075 g/l
Monoethoxylated Propargyl Alcohol: 0.015 g/l
Pyridinium-2-hydroxypropyl Sulfobetaine: 0.015 g/l It is of course understood that the nickel salts in the above formulations can be replaced or augmented by other nickel salts and conventional plating salts of cobalt and/or iron. When iron salts are present, it often is advantageous to include in the bath an iron solubilizing agent, such as citric, glutaric or ascorbic acid. Similarly, it often is advantageous to minimize gas pitting by including a wetting agent such as sodium laural sulfate or sodium dialkyl sulfosuccinate. It also will be understood that one can substitute other known buffers for the boric acid employed above or omit a buffer entirely.

The quaternary amine-sulfobetaine brighteners employed in this invention are effective at concentrations as low as about 5 milligrams per liter of bath and often can be used advantageously in concentrations as high as about 10 grams per liter or higher Preferably a working bath will contain from about 10 to about 120 mg/l, with amounts towards the upper end of the range most preferred. Generally, the use of concentrations of betaines below the useful range will produce little effect. The use of too high a concentration will tend to cause striations and pitting in the electroplate.

They can be employed as the sole brightener in the bath or can be used in conjunction with any conventional Class I brightener, such as sodium o-sulfobenzimide, dibenzene sulfonimide, allyl sulfonamide, saccharin or naphthalene trisulfonic acid, and/or any conventional Class II brightener, such as propargyl alcohol, butynediol or fuchsin. Outstanding results are obtained by employing from about 0.01 to about 0.8 grams per liter of the quaternary amine-sulfobetaines of this invention in conjunction with from about 0.005 to about 0.3 grams per liter of an acetylenic alcohol, ethoxylated acetylenic alcohol, such as propargyl alcohol, monoethoxylated propargyl alcohol or diethoxylated butynediol, or propxylated acetylenic alcohol. Generally the ratio of total betaine to total acetylenic alcohol, including ethoxylated and propoxylated moieties is between about 0.2:1 and 50:1.

It will of course be understood that various additions and modifications may be made in the embodiments described above without departing from the spirit and scope of the invention as defined in the claims below.

We claim:

1. A quaternary amine-hydroxypropane sulfobetaine of the formula

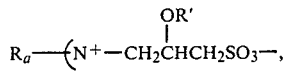

wherein (N+ is a heterocyclic tertiary amine group selected from a pyridine, quinoline or isoquinoline group,
R is a halogen or lower alkyl group,
R′ is an R″C(O)— group,
R″ is a lower alkyl group and
a is 0–5.

2. The quaternary aminehydroxypropane sulfobetaine of claim 1, wherein said unsubstituted tertiary aromatic amine is pyridine.

3. The quaternary aminehydroxypropane sulfobetaine of claim 1, wherein said unsubstituted tertiary aromatic amine is quinoline.

4. The quaternary aminehydroxypropane sulfobetaine of claim 1, wherein said unsubstituted tertiary aromatic amine is isoquinoline.

* * * * *